United States Patent [19]

Huang et al.

[11] Patent Number: 4,577,691

[45] Date of Patent: Mar. 25, 1986

[54] METHOD AND APPARATUS FOR PRODUCING VISCOUS HYDROCARBONS FROM A SUBTERRANEAN FORMATION

[75] Inventors: Wann-Sheng Huang; Sze-Foo Chien, both of Houston, Tex.

[73] Assignee: Texaco Inc., White Plains, N.Y.

[21] Appl. No.: 649,260

[22] Filed: Sep. 10, 1984

[51] Int. Cl.[4] ..... E21B 43/24; E21B 43/30

[52] U.S. Cl. ..... 166/263; 166/50; 166/57; 166/272; 166/303

[58] Field of Search ..... 166/263, 272, 302, 303, 166/50, 57

[56] References Cited

U.S. PATENT DOCUMENTS

| | | | |
|---|---|---|---|
| 3,280,909 | 10/1966 | Closmann et al. | 166/263 |
| 3,338,306 | 8/1967 | Cook | 166/50 X |
| 3,994,340 | 11/1976 | Anderson et al. | 166/57 X |
| 4,099,570 | 7/1978 | Vandergrift | 166/50 X |
| 4,265,485 | 5/1981 | Boxerman et al. | 166/272 X |
| 4,344,485 | 8/1982 | Butler | 166/50 X |
| 4,410,216 | 10/1983 | Allen | 166/263 X |
| 4,434,851 | 3/1984 | Haynes, Jr. et al. | 166/272 |
| 4,456,005 | 6/1984 | Heim et al. | 166/272 X |
| 4,479,541 | 10/1984 | Wang | 166/50 X |
| 4,508,172 | 4/1985 | Mims et al. | 166/50 X |
| 4,523,644 | 6/1985 | Dismukes | 166/57 X |

FOREIGN PATENT DOCUMENTS

| | | | |
|---|---|---|---|
| 782369 | 4/1968 | Canada | 166/50 |

*Primary Examiner*—George A. Suchfield

*Attorney, Agent, or Firm*—Robert A. Kulason; James J. O'Loughlin; Robert B. Burns

[57] ABSTRACT

Method and apparatus for thermally stimulating bitumen and other viscous hydrocarbon products from a subterranean formation in which the product is held. A plurality of wells are formed in the layer, which wells extend from the surface into a generally horizontal direction through the productive subterranean layer. The respective wells are spaced vertically apart whereby a thermal stimulating fluid such as steam can be selectively injected into discrete segments of the layer. Such injection will achieve the most effective sweeping action by the stimulating fluid through the productive layer. There results an orderly downward flow of the produced product and a more uniform and efficient distribution of heat in the stimulated formation.

8 Claims, 4 Drawing Figures

METHOD AND APPARATUS FOR PRODUCING VISCOUS HYDROCARBONS FROM A SUBTERRANEAN FORMATION

BACKGROUND OF THE INVENTION

In the extraction of viscous hydrocarbon products such as crude oil from a subterranean reservoir or formation, production is often hampered by a number of factors. These inlcude the inability of the gas pressure in the formation to urge the viscous product to the surface. Similarly, in the production of bitumen from a tar sand substrate the viscosity of the bitumen is such that it is virtually immovable while retained in its in situ state.

Toward facilitating the production of these viscous hydrocarbon products, methods have been provided to lessen the viscosity of the retained products and to promote their movement through the substrate and toward a producing well.

In the instance of bitumen contained within tar sand formations, the latter can be relatively thin in comparision to the normal subterranean reservoir wherein crude oil is retained. A productive layer, however, even though comprised of tar sands, can be hundreds of feet in thickness. It has therefore become practical when extracting bitumen or crude oil from such a layer, to utilize horizontal rather than vertical or diverter type wells.

In such an installation, the well or wells are spudded into the substrate in such manner as to approach the overburden layer either vertically or at an angle. Thereafter, as the wellbore enters and penetrates the productive layer, it is diverted into a substantially horizontal direction. Preferably, the wellbore will be urged in a direction such that it will run concurrently with the productive layer.

With the or more horizontal wells formed into a productive layer, it is possible to use at least one of the wells for injecting a hot stimulating fluid. The latter usually comprises water or steam which are forced into the formation. In either instance, contact between the hot stimulating medium and the hydrocarbon will gradually transform the latter into flowable condition.

Steam, with or without additive materials, is often utilized as the stimulating medium. Thereafter, the resulting hot condensate will form an emulsion with the flowable hydrocarbon and be in producible form.

As a general practice, thermal stimulation of a productive layer is initiated by first raising the environment of the well or wells to a temperature at which the viscosity of the contained hydrocarbon is reduced. Thereafter, further injection of pressurized steam will urge the flowable hydrocarbon emulsion toward a lower pressure producing well or toward a lower pressure portion of the single well.

If a single well is used, the huff and puff method for producing can be employed by alternately injecting hot stimulating fluid selectively into the well. Thereafter, a pumping procedure extracts the emulsion from the well for further treatment and separation.

In the instance of a productive substrate which covers a great depth, a considerable amount of steam can be used before the hydrocarbon is produced. In other words, when steam is injected into an expansive productive layer that runs for a considerable depth, much of the steam will be dissipated and wasted. Further, in such an instance, there is presently lacking a feasible way of accurately determining the extent to which the production layer is being heated and produced.

As in any operation where hydrocarbon is produced from a subterranean formation, it is a primary objective to remove the greatest amount of product while using a minimal amount of stimulating medium. It is thus mandatory, in order to achieve a higher degree of efficiency, that the bitumen or the hydrocarbon containing layer be swept or penetrated in a manner that the maximum amount of hydrocarbon is removed with as little wasted heat as possible.

This objective is achieved as hereinafter described, by the particular disposition of wells within a productive layer whereby to regulate the flow and function of a stimulating medium which is injected into the formation.

There is presently disclosed a method for producing a viscous hydrocarbon such as bitumen or crude oil from a subterranean layer or formation by a plurality of wells or peferably from a well array. The latter is formed in said layer in a manner such that the respective wells lie in a substantially horizontal alignment, vertically spaced, and positioned at different levels or depths.

The respective wells preferably originate from a common area or pad at the surface. They thereafter penetrate the overburden, and are diverted into a substantially horizontal direction through the productive layer. Production of hydrocarbon emulsion thereafter results by virtue of the selective introduction of a hot pressurized stimulating fluid in a manner that the productive layer will be most effectively swept and drained of the contained hydrocarbon.

To most effectively sweep a formation, and optimize the usage of steam, a plurality of horizontal wells are formed as noted, in substantially vertical alignment. The wells are spaced to define a series of contiguous, horizontal formation segments therebetween. The latter in effect are striated by the respective parallel wells.

Thereafter, selective introduction of a heating medium into the various wells progressively heats the contiguous segments and results in an orderly, efficient downward flow of the hydrocarbon in emulsion form. As each parallel segment is heated and produced, the next lower adjacent segment is similarly treated and produced.

It is therefore an object of the invention to provide an efficient method to thermally stimulate a subterranean formation for the production of viscous hydrocarbons therefrom.

A further object is to provide a method for the stimulation of a viscous hydrocarbon containing substrate in a manner to cause an orderly downward flow of hydrocarbon emulsion into a producing well.

Another object is to provide an array of horizontally disposed, and vertically spaced apart wells within a subterranean productive layer, which arrangement will assure the most efficient extraction of hydrocarbon product in response to the introduction of a hot stimulating fluid into the substrate.

A still further object is to provide a method and an arrangement of wells in a tar sand formation for producing bitumen emulsion sequentially from adjacent horizontal segments of the productive layer.

In achieving the above objectives, the instant method provides firstly an arrangement or array of wells disposed within the hydrocarbon containing formation or layer. The respective wells pass either vertically or at an angle through the overburden which covers the productive layer. Thereafter, as the wellbore approaches the productive layer it is diverted to advance in a substantially horizontal direction preferably concurrently with the direction of the layer.

The respective parallel wells function to delineate a series of horizontal productive segments within the productive layer. Each segment can thereafter be individually thermally treated and produced.

As the upper segment of the formation is produced, an aqueous cap is applied thereto to preserve the thermal character of the substrate. The cap will further fill the voids which have been formed by removal of the hydrocarbon from said segment.

The various wellbores are drilled into the productive layer and provided with completions generally in the form of metallic liners. The latter are preferably perforated to permit the egress of steam, and the ingress of hydrocarbon emulsion. Thereafter, the selective introduction of hot stimulating fluid to particular wells causes the well and its immediate environs within a discrete segment, to be further heated. This will force hot hydrocarbon emulsion downwardly into the well at the lower side of said discrete segment.

When a treated layer segment has been substantially exhausted of hydrocarbon emulsion as witnessed by the rate of production at the surface, the next lower or contiguous horizontal segment will be similarly treated and produced. Over a period of time each of the respective horizontally defined productive segments will be treated in turn. The thermal treating steam is thereby most effectively utilized and the hydrocarbon emulsion follows a generally downward progression to be produced from a well at the lower side of each segment.

Figure 1:
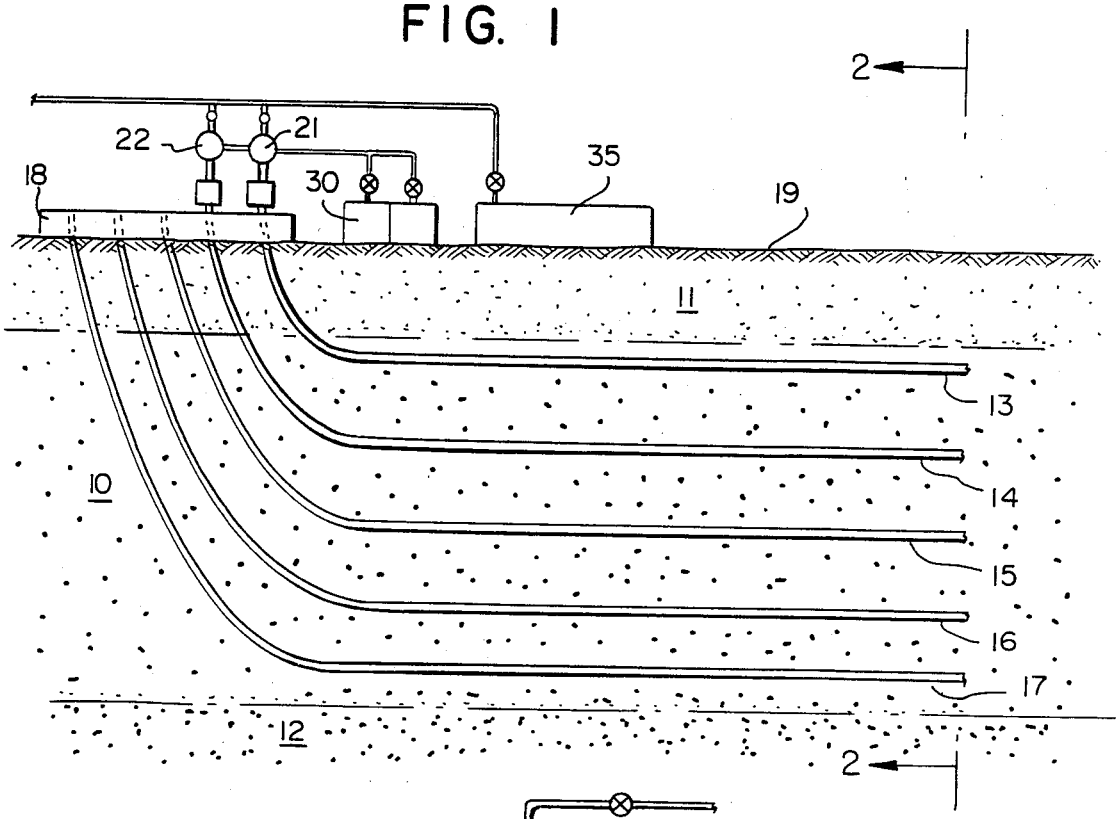
FIG. 1 illustrates a vertical cross-sectional segment of a productive formation including a plurality of wells having portions thereof disposed in a general horizontal direction.
Figure 2:
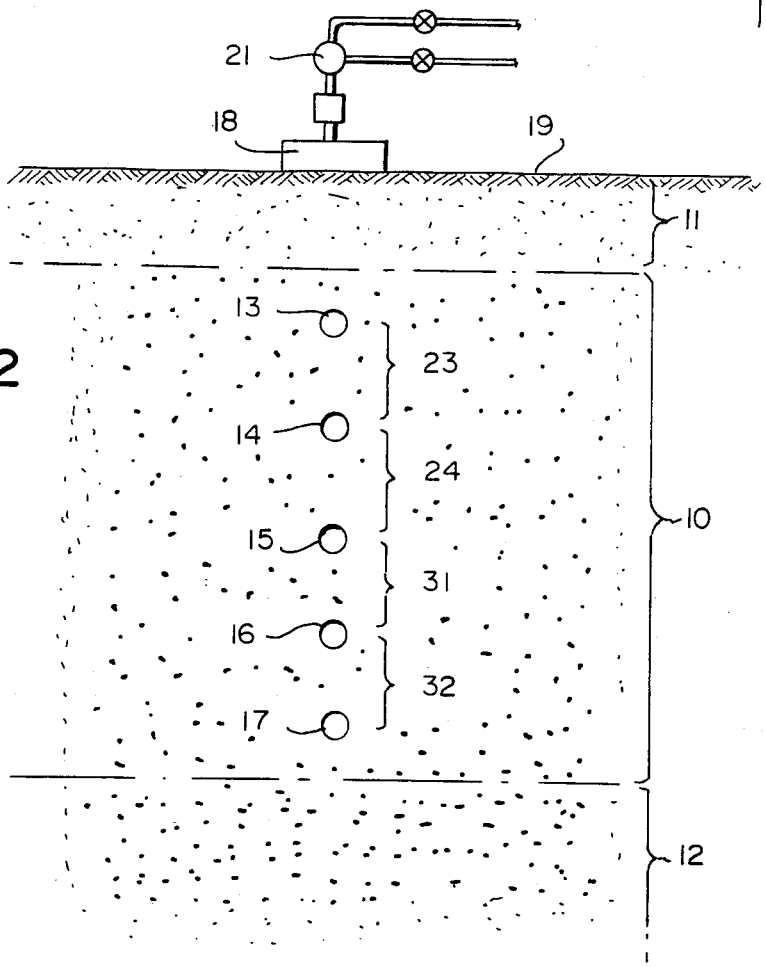
FIG. 2 is an end view of the formation taken along line 2—2 in FIG. 1.

Referring to the drawings, and to achieve the instant method, an array of wells as presently contemplated, is shown in FIGS. 1 and 2 positioned in a subterranean productive layer 10. For the present description, the productive substrate or formation will be considered to be a layer which can range in thickness from about 50 to several hundred feet. Where the productive layer is of such a magnitude as herein mentioned, a plurality of vertically spaced well completions are installed to achieve the desired striating of the formation into horizontal segments in which the various wells comprise the stria.

The present method as herein mentioned can be addressed to the production of a number of forms of viscous hydrocarbons. To simplify the description, however, reference will be hereinafter made only to the production of bitumen or bitumen emulsion from the productive layer 10 by steam injection.

Said productive layer 10 is normally comprised of an earthen material typified by tar sands as found in the Athabasca area of Canada. In such a substrate, a large part of the composition includes unconsolidated sands. The sand particles function to retain the bitumen in such a condition that the latter cannot be readily displaced or separated.

It is known, for example, that for producing bitumen it is necessary to thermally stimulate the product flow by introduction of steam into the substrate at such a pressure that it is forced into the formation. Steam, as a matter of practicality, is introduced at a sufficient pressure at the well head to penetrate the substrate adjacent to the respective wells. Thereafter the steam condensate will form a hot emulsion or mixture with the softened bitumen.

Productive layer 10 is generally, although not necessarily, covered with an unproductive overburden 11 which can extend for a relatively minimal distance or for several hundred feet in depth. In a similar manner, an underlayer 12 beneath the productive layer, comprises in effect an area which is lacking in the hydrocarbon product. Thus, the respective upper and lower areas which encompass tar sand layer 10 constitute non-definitive borders or edges to said layer.

As shown in FIGS. 1 and 2, tar sand layer 10 is provided with a plurality of horizontally arranged wells 13 to 17 inclusive. The respective wells extend for a distance of several hundred feet to most effectively achieve the maximum degree of efficiency and the subsequent downward sweeping action of steam through the layer. The number of vertically spaced walls actually needed will be a function of the overall thickness of productive layer 10 and the composition of the formation.

Upper well 13 is preferably commenced at a pad or central location 18 at surface 19. Said well is provided with the normal well head equipment 21. The latter functions to control the introduction of stimulant thereto and the subsequent removal of hot bitumen emulsion therefrom on a producing cycle.

The respective wells 13 to 17 inclusive as shown in FIG. 2, are spaced vertically apart to define a series of discrete productive segments such as 23 and 24 within the substrate therebetween. In such an arrangement, the respective productive segments are sequentially heated and produced one at a time. By thus limiting the volume of the productive area which is heated and produced, the heating medium is utilized to optimal efficiency.

Commencing of well 13 can be initiated at surface 19 in either a vertical direction or preferably at an angle offset from vertical to achieve penetration of overburden layer 11. Thereafer, as the wellbore enters the upper end of the productive layer 10, it is deviated by one of the usual methods to assume a horizontal alignment. Thus, well 13 extends concurrently with the tar sand layer in a direction usually parallel to the earth's surface.

The bore of second well 14 is likewise commenced at pad 18 and is also provided with a well head 22 to regulate passage of produced fluids and stimulating medium through said well. Well 14, as noted, is formed in a manner similar to first wellbore 13. The second wellbore, however, is diverted into a horizontal direction only at such time as it has reached a desired depth, and is vertically spaced below well 13.

In effect, the vertically spaced horizontal wells 13 and 14 are positioned to define the discrete productive segment 23 therebetween.

Thereafter, wells 15, 16 and 17, or as many more wells as required, are formed into layer 10 to define additional horizontal segments 31 and 32. By the selective and individual heating and producing of the respective segments, starting at the uppermost, downward flow of bitumen emulsion can be withdrawn sequentially from the respective wells in descending order.

Figure 3:
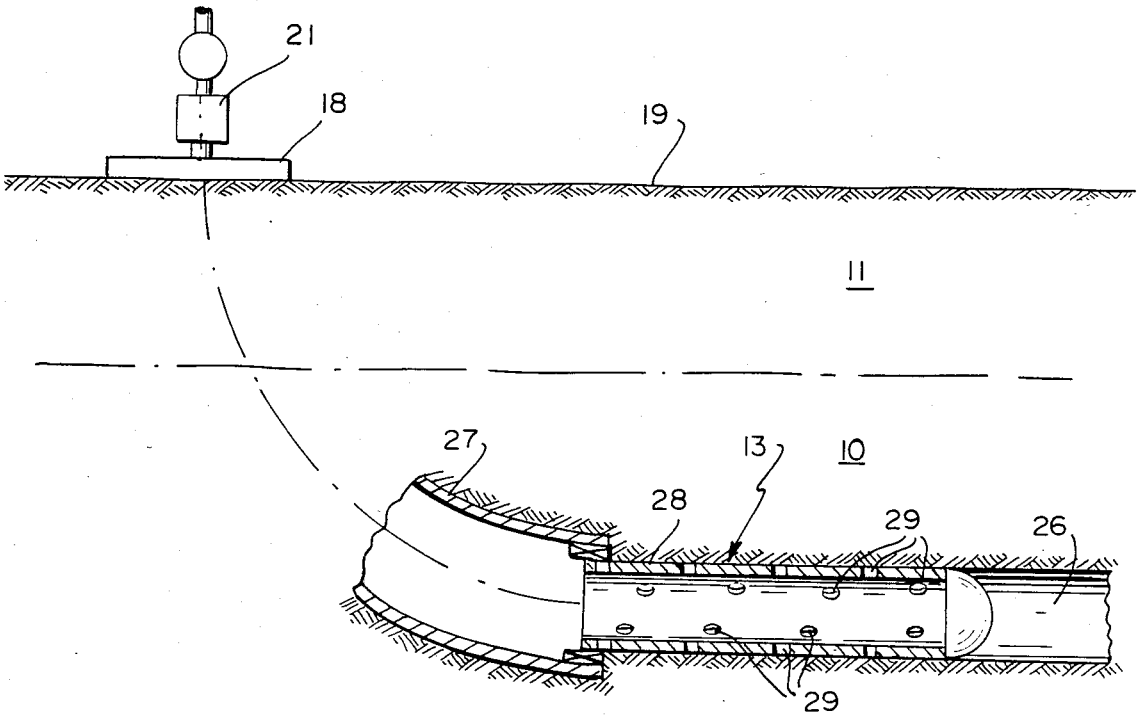
FIG. 3 is a segmentary view on an enlarged scale of one of the horizontal wells shown in FIG. 1.

A completion of the various wells as shown in FIG. 3, comprises basically a lengthy surface casing 27 which is cemented into wellbore 26, and extends upwardly to pad 18. A perforated liner 28 is thereafter inserted into the horizontal portion of the wellbore and engaged with surface casing 27 to conduct pressurized stimulating fluid into the productive, segment area adjacent thereto. The respective wells, as shown in FIG. 1, are manifolded to a source of steam 30 and to bitumen storage means 35.

A standard form of well liner 28 comprises generally a metallic cylindrical element such as a pipe, casing or the like. Said member further embodies a series of wall perforations 29 which can be either holes, or narrow slots, sufficiently large to permit the discharge of stimulating fluid. They will also be of a sufficient size to readily receive the flow of hot bitumen emulsion which will gravitate toward the lower wells.

Perforations 29 in the well liner 28 wall can be performed prior to liner 28 being registered within wellbore 26. However, said perforations can, by use of known peforating equipment, also be formed subsequent to installation of the liner within the bore.

Operationally, to commence production of bitumen emulsion from tar sand layer 10, and particularly from uppermost segment 23, the area between and about the respective wells 13 and 14 is initially preheated to a minimal predetermined temperature. The optimal temperature will depend on a number of factors incuding the composition of the substrate as well as the underground temperature.

As injected steam causes the bitumen in horizontal segment 23 to become less viscous, it mixes with hot condensate into a flowable bitumen emulsion. This preheating period can extend over several weeks or even months and will substantially increase the pressure within said horizontal segment 23.

After the initial preheating of segment 23, introduction of steam through well 14 is discontinued. However, steam introduction is continued through well 13 and initiated in well 15. Since the pressure in well 14 will now be abruptly decreased, the flow of hot bitumen emulsion into the intermediate well 14 will commence.

Thereafter, steam injection by way of well 13 will continue until it becomes apparent from the emulsion production rate at well 14, that segment 23 is substantially depleted of its bitumen content.

This factor will become evident by the added outflow of steam through well head 22 at producing well 14. This indicates that steam is passing through the voids and channels created by the exiting bitumen. The further introduction of steam will be wasteful and unproductive.

During this heating and producing period, steam introduction has been initiated, preferably at a lower pressure than steam into well 13, by way of well 15 to heat the next lower contiguous horizontal segments 24. However, with the end of the bitumen production through well 14, water is introduced by way of well 13 to form a liquid cap on the uppermost horizontal segment 23. The inflowing water will as noted occupy the voids and the channels created in the formation by the outflowing bitumen. Further, the injected water will tend to sustain the formation pressure therebeneath.

When the liquid or water cap has been applied to segments 23, pressurized steam injection will again be commenced by way of well 14 to enter segment 24. This is in anticipation of a producing step whereby the downflowing bitumen from segment 24 will be extracted. Since said segment 24 has received a degree of initial preheating during the previous producing step, the present heating from upper well 14 will prompt further bitumen emulsion formation.

By reducing the pressure at well 15 at the lower edge of segments 24, bitumen will be produced at said well while concurrently heating of the next lower horizontal segment 31 will be commenced. Over a period of time, as formation segment 24 is produced though well 15, the next lower adjacent segment 31 will be subjected to preheating by way of well 16.

As each successive horizontal formation segment becomes depleted of bitumen, the upper liquid cap will be applied through the well at said segment upper edge. However, since steam is introduced to the lower edge of the horizontal segment the steam will be confined so that its use is most effectively applied rather than having it dissipated over a larger productive area or through the depleted upper formation segments.

Figure 4:
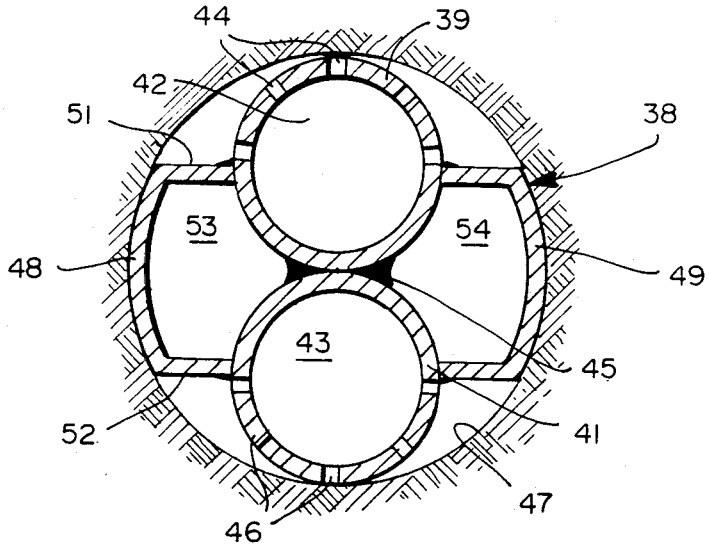
FIG. 4 is an alternate embodiment of a well liner applicable to the instant method.

A preferred method for assuring production from a formation by horizontal segments, utilizes directional introduction of the hot steam and the subsequent water. One embodiment of a well liner which is capable of handling both the stimulating and production functions, is illustrated in FIG. 4.

As shown, well liner 38 includes a plurality of elongated conductors 39 and 41 disposed one above the other to define flow passages 42 and 43. Each of said elongated conductors is provided with a plurality of ports or openings 44 and 46 formed in the respective walls.

Conductors 39 and 41 are joined along their length at a welded joint 45 to form a unitary member. Upper conductor 39 includes openings 44 which are aligned in a general upward and outward direction along a limited radial segment of approximately 180° of said conductor's wall.

Openings 46 formed in the lower wall of lower conductor 41 also are aligned to direct steam or water in an outward and downward direction. Thus, pressurized steam and water flows which issue from the respective conductors, will assume a desired direction.

To facilitate registering liner 38 within a horizontal borehole 47, the dual conductor arrangement is formed that the upper and lower surfaces of conductors 39 and 41 respectively will slidably engage the borehole corresponding walls. Further, well liner 38 is provided with lateral protrusions in the form of side panels 48 and 49. The latter extend outwardly of the liner, having a curved peripheral edge which substantially conforms to, and slidably engages the borehole 47 walls.

Each lateral panel, 48 for example, is comprised of upper and lower connector elements 51 and 52 which extend inwardly to engage and depend from a conductor wall. Said panels 48 and 49 are welded to the respective conductors at elongated seams to in effect define closed compartments 53 and 54 which are capable of receiving and conducting bitumen emulsion flow.

To maintain the thermal quality of steam used in the formation stimulating function, compartments 53 and 54 can be provided with tracer lines to conduct a flow of steam therethrough. Thus, the temperature of the entire liner 38 can be maintained at a preferred operating level during the heating phases. Said elevated temperature will be sufficient to sustain the thermal quality of the steam along its path prior to injection into the formation. It will further maintain a heated path along which bitumen emulsion will flow as it is conducted toward the well head thereby to assure fluidity of the emulsion.

To foster reception of hot bitumen emulsion into liner 38, upper conductor connector element 51 as shown is tilted downwardly toward the seam at conductor 39 wall. It thus terminates adjacent to and beneath wall ports 44. The downwardly flowing hot bitumen emulsion from the formation will therefore be channelled toward the lower pressure passage 42 during a producing cycle when the formation segment above said conductor 39 has been stimulated.

It is appreciated that while the disclosed well liner does constitute a prefered embodiment of a dual conductor member, adapted to the present process, similar embodiments can be utilized without departing from the spirit and scope of the invention.

It is further understood that although modifications and variations of the invention can be made without departing from the spirit and scope thereof, only such limitations should be imposed as are indicated in the appended claims.

We claim:

1. Method for thermally enhanced production of a viscous hydrocarbon fluid from a productive layer of a formation in which the viscous hydrocarbon is releasably held, whereby to progressively heat discrete segments of the formation to decrease the viscosity of said hydrocarbon fluid, which method includes the steps of;

forming in said formation a plurality of substantially parallel well completions which extend in a generally horizontal direction and which are vertically spaced apart one from the other to define a series of contiguous horizontal formation segments striated by the respective well completions, selectively introducing steam to the upper one of said contiguous horizontal formation segments whereby to release hydrocarbon fluid therefrom and to enhance the downward flow of a hot hydrocarbon emulsion, and producing said hydrocarbon emulsion from said horizontal well completion positioned at the lower side of said upper horizontal formation segment, and thereafter individually heating said discrete horizontal formation segments one at a time in descending order, and producing emulsion form each of said horizontal segments by way of the well completion immediately below the heated segment.

2. In the method as defined in claim 1, including the step of;

preheating the next lower horizontal formation segment to a formation segment thereabove which is being produced, concurrently whereby to initiate fluidization of the hydrocarbon fluid in said next lower horizontal segment.

3. In the method as defined in claim 2, including the step of;

introducing a liquid medium into the upper side of said horizontal formation segment to define a fluid cap for heating medium being introduced to the horizontal segment immediately therebelow.

4. In the method as defined in claim 3, including the step of; maintaining said liquid cap on the productive layer as each succeeding horizontal segment thereof is produced.

5. A well liner for insertion into a horizontal extending well bore within a productive formation which releasably holds a viscous hydrocarbon, to release the hydrocarbon by thermal stimulation through the introduction of a hot pressurized heating medium into said formation, which well liner includes a plurality of discrete conductors disposed one above the other, that are capable of selectively directing said pressurized heating medium into the formation, and of conducting the hydrocarbon emulsion therefrom, perforations formed in the walls of said discrete conductors, lateral panels which depend from and commonly engage the respective conductors, each of which panels includes a contoured wall positioned to slidably engage the adjacent well bore wall during insertion of the liner into said well bore.

6. In the apparatus as defined in claim 5, wherein the respective lateral panels define longitudinal passages along opposed sides of said well liner.

7. In the apparatus as defined in claim 6, wherein said longitudinal passages are provided with means for introducing a heating medium thereto.

8. In the apparatus as defined in claim 6, wherein said longitudinal passages are provided with means for circulating a heating medium therethrough.

* * * * *